US010549829B1

(12) United States Patent
Vinokur et al.

(10) Patent No.: US 10,549,829 B1
(45) Date of Patent: Feb. 4, 2020

(54) SNORKEL SYSTEM

(71) Applicants: Anthony Vinokur, San Francisco, CA (US); Pavel Flider, San Rafael, CA (US); Galina Levinson, San Francisco, CA (US)

(72) Inventors: Anthony Vinokur, San Francisco, CA (US); Pavel Flider, San Rafael, CA (US); Galina Levinson, San Francisco, CA (US)

( * ) Notice: Subject to any disclaimer, the term of this patent is extended or adjusted under 35 U.S.C. 154(b) by 27 days.

(21) Appl. No.: 16/164,063

(22) Filed: Oct. 18, 2018

(51) Int. Cl.
*B63C 11/20* (2006.01)

(52) U.S. Cl.
CPC ..... *B63C 11/205* (2013.01)

(58) Field of Classification Search
CPC ..... B63C 11/205; B63C 11/16; B63C 11/207; B63C 11/186; A62B 9/06
See application file for complete search history.

(56) References Cited

U.S. PATENT DOCUMENTS 6,318,363 B1 * 11/2001 Monnich ..... B63C 11/205 128/201.11
6,513,520 B2 2/2003 Vinokur et al.
7,069,927 B1 * 7/2006 Pan ..... B63C 11/205 128/201.11
2002/0170558 A1 * 11/2002 Vinokur ..... B63C 11/205 128/201.11
2004/0079366 A1 * 4/2004 Kawashima ..... B63C 11/205 128/201.11
2007/0068519 A1 * 3/2007 Christianson ..... B63C 11/205 128/201.11
2007/0131227 A1 * 6/2007 Wheelwright ..... B63C 11/205 128/201.22
2008/0047552 A1 * 2/2008 McCarthy ..... B63C 11/205 128/201.11
2008/0072897 A1 * 3/2008 McCarthy ..... B63C 11/205 128/201.11
2008/0092883 A1 * 4/2008 Shiue ..... B63C 11/205 128/201.11
2010/0229858 A1 * 9/2010 Wheelwright ..... B63C 11/205 128/201.11

* cited by examiner

*Primary Examiner* — Tu A Vo
(74) *Attorney, Agent, or Firm* — Vierra Magen Marcus LLP

(57) ABSTRACT

The present technology relates to a snorkel which includes a breathing tube having a first end received in a mouth of a user and an upper opening in a second end opposite the first end. The snorkel further includes a housing around the upper opening which includes a slot. The housing and slot together trap an air pocket within the housing when the housing is submerged underwater, with the upper opening of the breathing tube positioned in the air pocket to prevent water from entering the upper opening.

15 Claims, 8 Drawing Sheets

(Line 5-5)

SNORKEL SYSTEM

BACKGROUND

Snorkels are well known to include shaped breather tubes enabling users to swim with their face immersed in the water while breathing through the tube. Typically, a snorkel includes a first end having a mouthpiece. The mouthpiece is attached to an elongate tube that is curved so that a second end of the snorkel may be positioned upwardly above the head of the user. With the second end out of the water, the user may position his or her face within the water while still being able to breathe freely through the breather tube.

A problem with conventional snorkel devices is that they accumulate water within the breather tube at a result of the second end of the snorkel submerged beneath the water surface. This may occur for example where the user decides to dive beneath the water surface. This may also occur in rough water or swells, where the water levels may change quickly and rise above the height of the second end of the snorkel. Another problem with conventional snorkel devices is that, once water gets into the breather tube, the user is required to purge the water within the breather tube prior to being able to inhale via the breather tube.

Some snorkels include valves for keeping the water out of the breather tube while allowing air into and out of the tube. However, water still penetrates through the valve. Additionally, even where a valve may operate well initially, such valves are prone to wear and water leakage over time.

DETAILED DESCRIPTION

Figure 1:
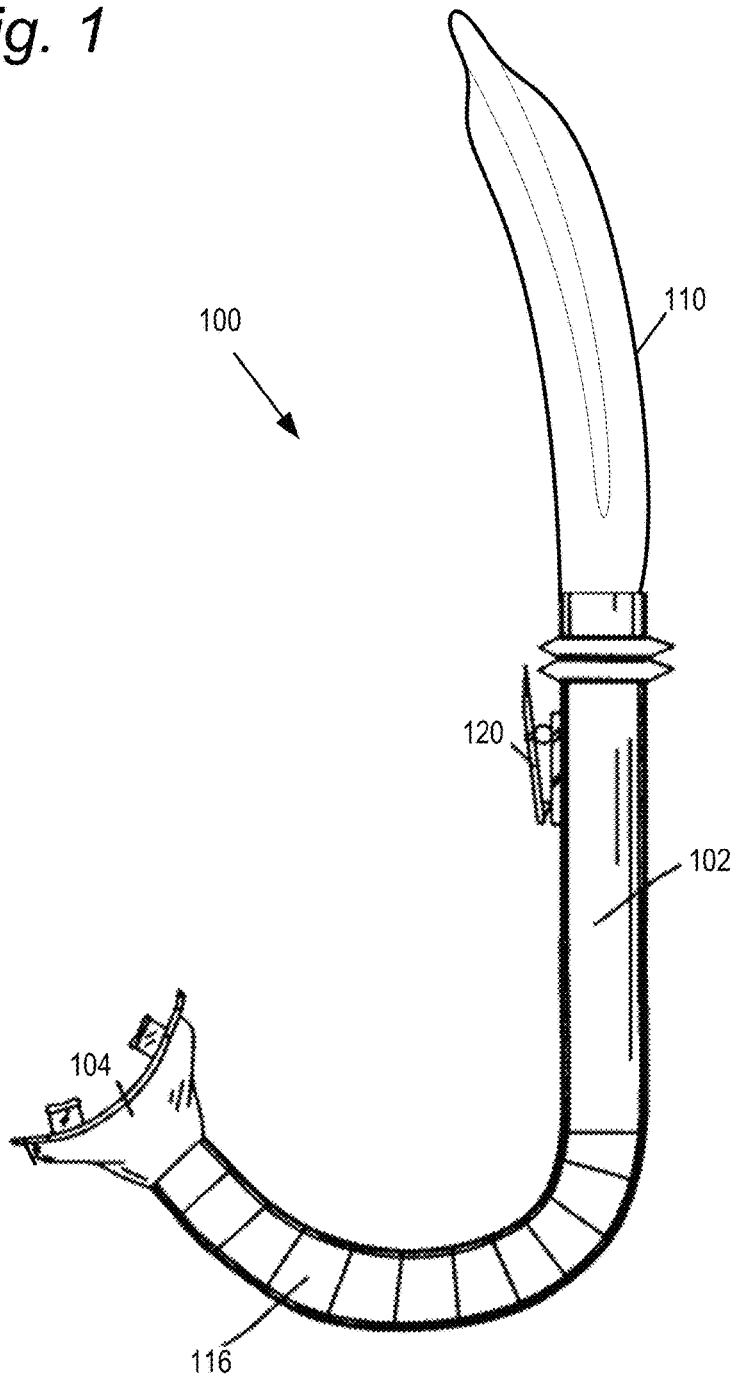
FIG. 1 is a side view of a snorkel according to embodiments of the present technology.
Figure 2:
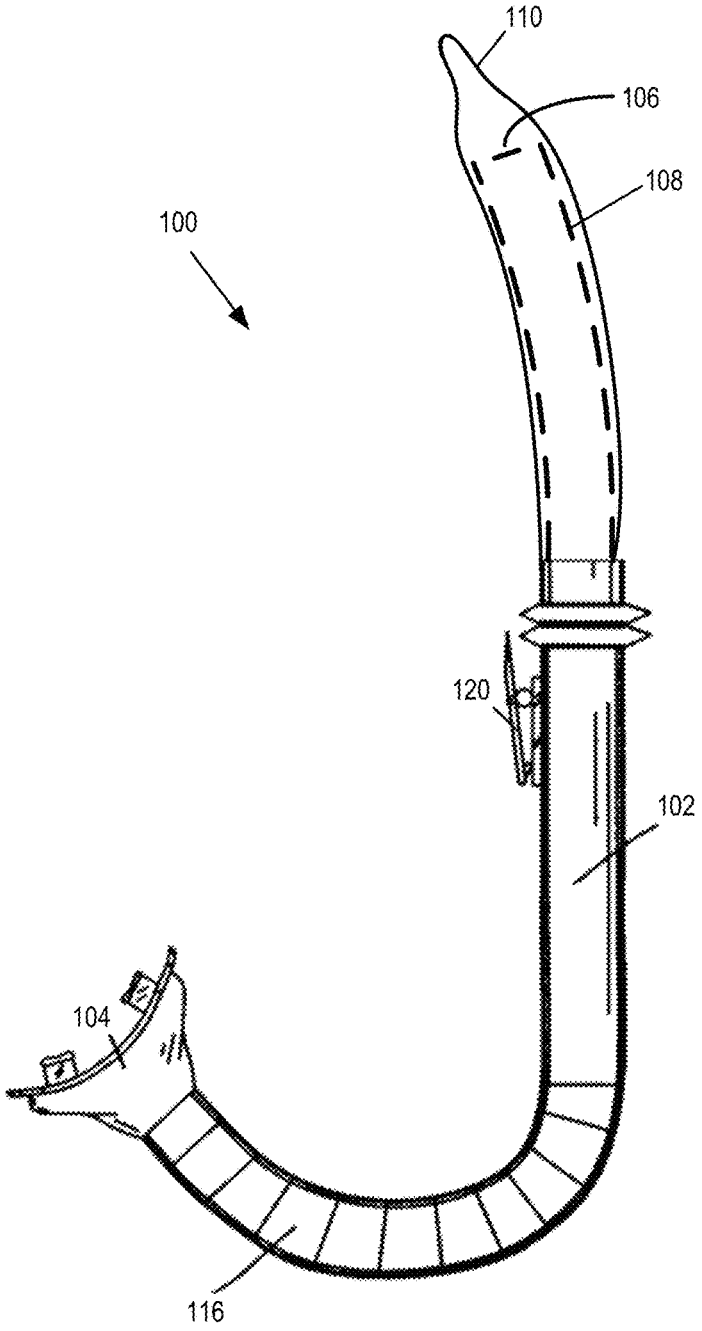
FIG. 2 is a side view of a snorkel showing a breathing tube within the housing according to embodiments of the present technology.

The present technology will now be described with reference to the figures, which in embodiments, relate to a snorkel system with a design that keeps water out of the breathing tube when submerged under water, as well as splashes, rain, waves and water mist such as rain when above the water surface. It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower" and "vertical" and "horizontal," and forms thereof, as may be used herein are by way of example and illustrative purposes only, and are not meant to limit the description of the technology inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±2.5% of a given dimension.

An embodiment of the present technology will now be explained with reference to the views of a snorkel 100 shown in FIGS. 1-11. Referring initially to the side, front, cross-sectional and perspective views of FIGS. 1-6, the snorkel 100 comprises a breathing tube 102 having a mouthpiece 104 at a first end, and an upper opening 106 (FIG. 2) at a second end opposite the first end. The breathing tube 102 preferably includes a bend in a lower portion 116 which allows the snorkel to extend around a head of a user so that the upper portion 108 and housing 110 may be out of the water while the user's face is submerged within the water. An upper portion 108 of the breathing tube 102 including the upper opening 106 is enclosed within a housing 110 attached about the upper portion 108 of the breathing tube 102. The upper portion 108 and upper opening 106 are shown in phantom in FIGS. 2 and 4 within the housing 110. In embodiments, an upper edge of the opening 106 may be slanted, as shown for example in FIG. 4. This slant will redirect exhaled, carbon dioxide rich air from the breathing tube opening 106 in the direction of arrow 114, where can exit from a slot 112 (explained below). Without such a slant, exhaled air is more likely to get trapped in a top portion of the housing 110 where it can be re-inhaled. The slant in opening 106 may be omitted in further embodiments.

The housing 110 is comprised of a solid impermeable material such as but not limited to plastic or metal. As explained below, the housing 110 and slot 112 cooperate with each other to prevent water from entering the upper opening 106 of the breathing tube 102 when the snorkel 100 is submerged beneath a surface of water.

Figure 3:
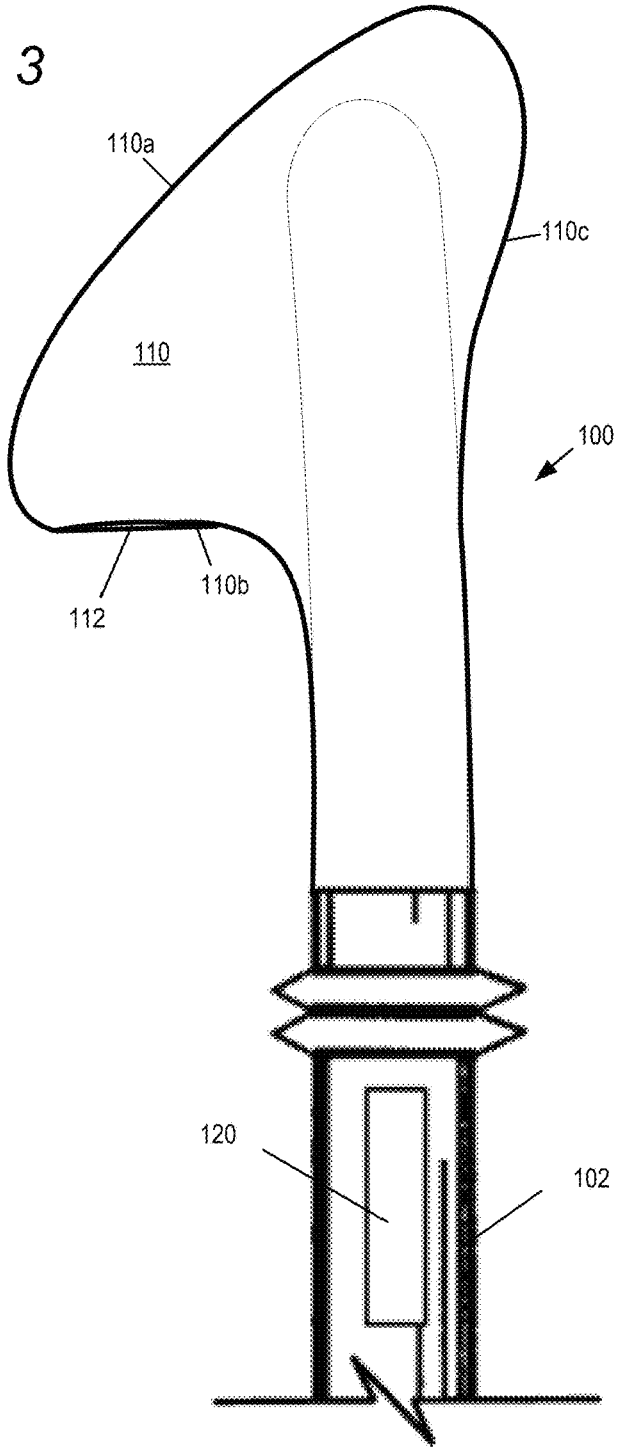
FIG. 3 is a front view of a portion of a snorkel according to embodiments of the present technology.
Figure 4:
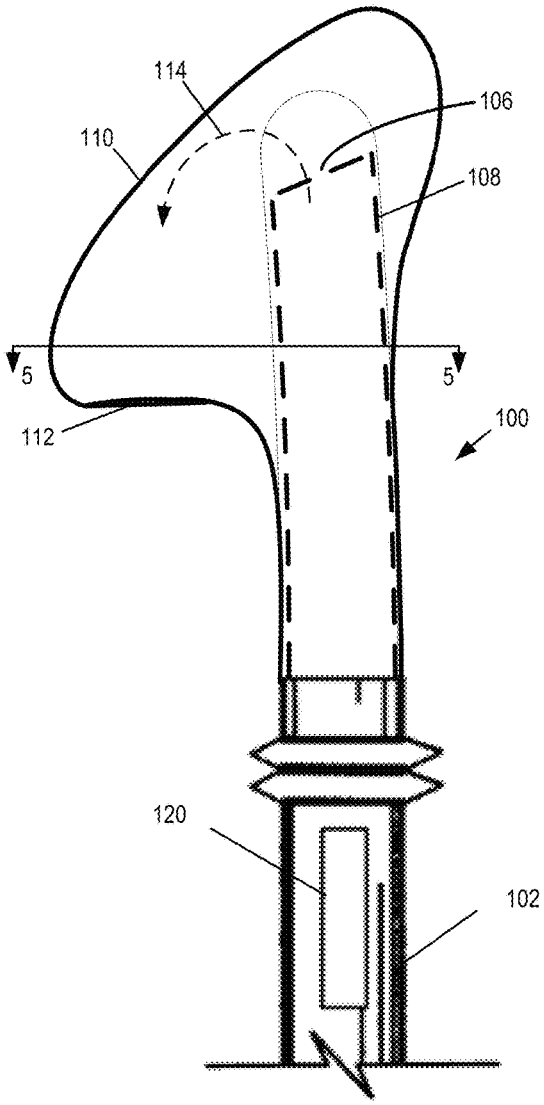
FIG. 4 is a front view of a portion of a snorkel showing a breathing tube within the housing according to embodiments of the present technology.
Figure 5:
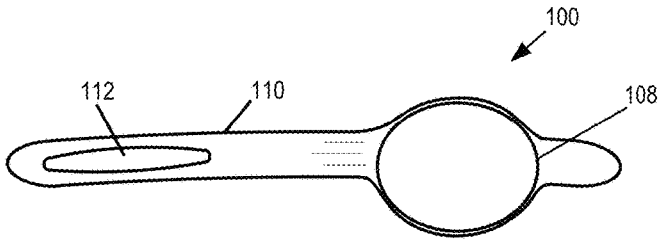
FIG. 5 is a cross-sectional view of a snorkel according to embodiments of the present technology through line 5-5 of FIG. 4.
Figure 6:
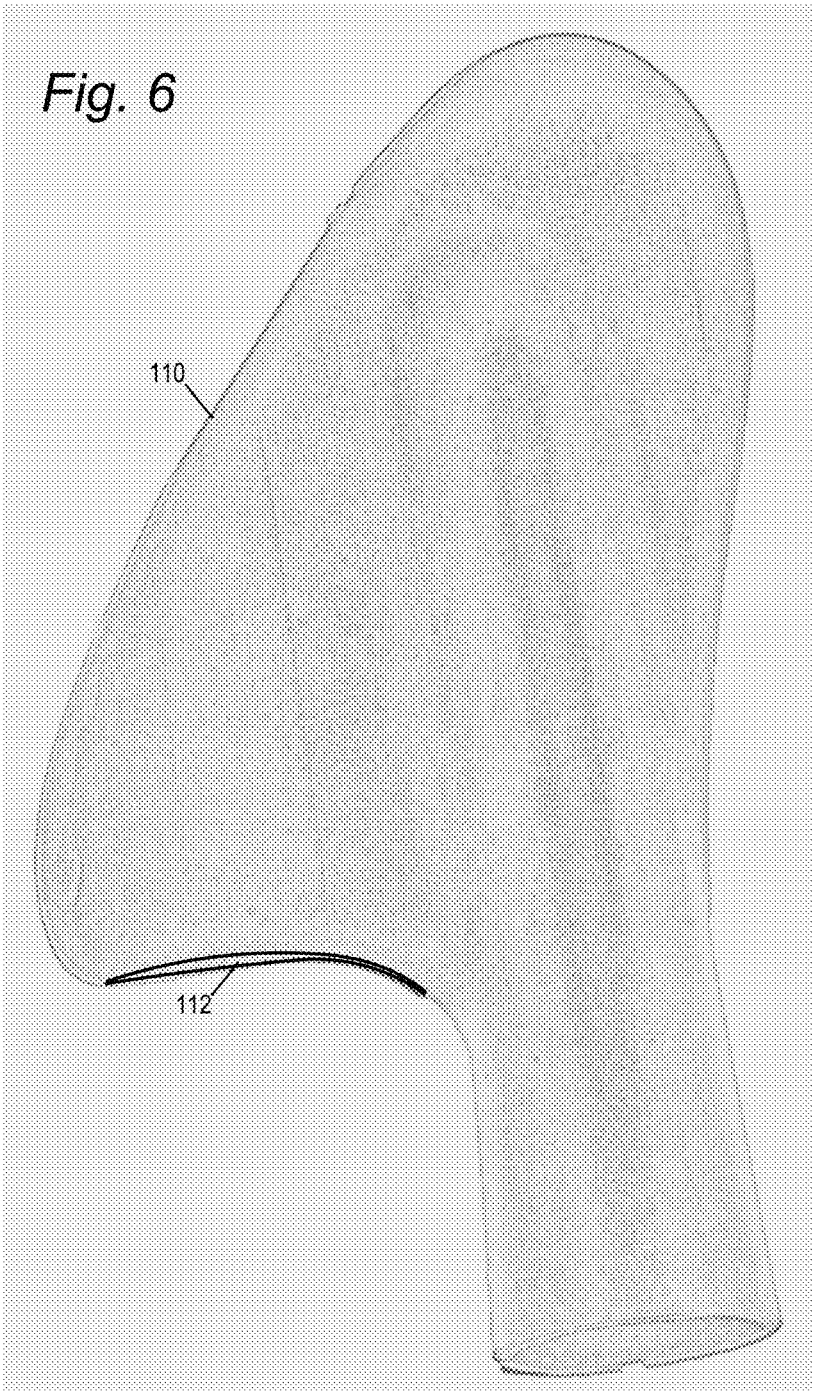
FIG. 6 is a perspective view of a housing used on a snorkel according to embodiments of the present technology.
Figure 7:
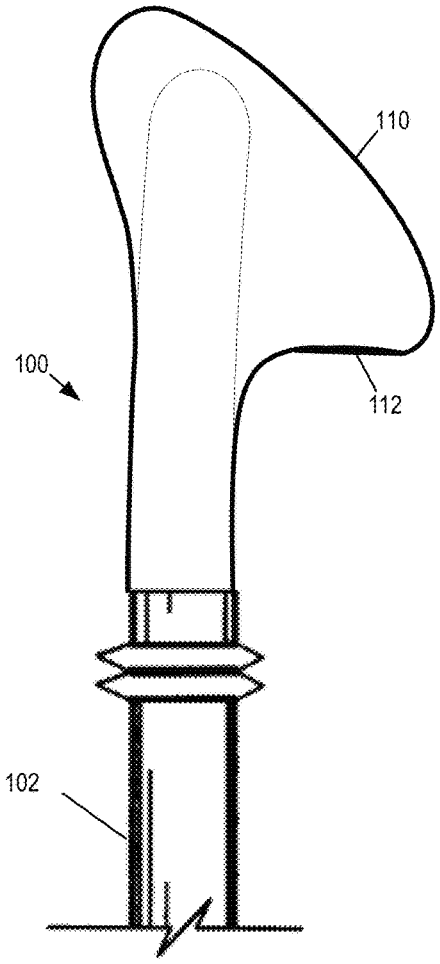
FIG. 7 is a rear view of a portion of a snorkel according to embodiments of the present technology.
Figure 8:
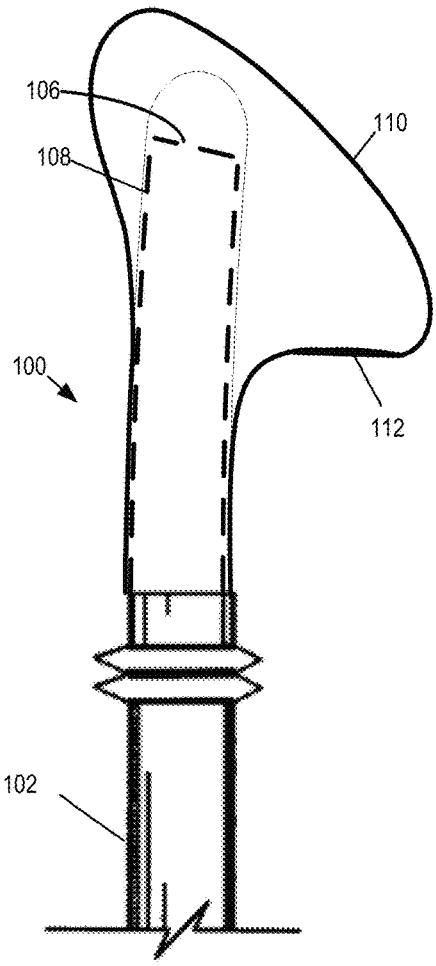
FIG. 8 is a rear view of a portion of a snorkel showing a breathing tube within the housing according to embodiments of the present technology.

FIGS. 3 and 4 show a front view of the snorkel 100, and FIGS. 7 and 8 show a rear view of the snorkel 100 (a bottom portion of the snorkel 100 is omitted from FIGS. 3-4 and 6-8 for clarity). In embodiments shown for example in FIG. 3, the housing 110 in front view may have a generally angled front edge 110*a*, a generally flat, horizontal edge 110*b* (when snorkel 100 is upright), and a generally curved rear edge

110*c*. The edges together give the housing the shape approximating that of a dorsal fin in the water. Such a shape provides several advantages.

For example, Darwinism has evolved the shape of a dorsal fin over millennia to be streamlined and hydrodynamic as it moves through the water, with a shape that minimizing drag as it moves through the water. Providing the housing 110 with such a shape in front view similarly results in a streamlined and hydrodynamic profile. The housing 110, in side view, has a generally flat profile that is curved to fit the contour of a user's head, as explained below with respect to FIG. 11. This further facilitates the streamlined and hydrodynamic operation of the housing 110.

Moreover, this shape, in particular flat edge 110*b* allows the slot 112 to be provided generally horizontally and residing at a bottom portion of the housing, in a plane that is generally parallel to the surface of the water when the housing 110 is upright in the water. The dimensions of the slot 112 may vary, but in one embodiment, the slot may be between 1 to 2 inches long and between 0.25 and 0.5 inches wide. The slot 112 may be longer/shorter or wider/narrower than this in further embodiments. The position, orientation and shape of the slot 112 all provide advantages to the snorkel 100 of the present technology.

For example, with respect to the position, it is advantageous to maximize the amount of space between the slot 112 and the upper opening 106 of the breathing tube 102. This distance is maximized in the current technology by providing the slot 112 in the bottom edge 110*b* of the housing 110. In one embodiment, the slot 112 may be about 3 inches from the opening 106 in breathing tube 102 (along an axis of the upper portion 108). In this position, the chance of water entering into slot 112 and going upward against the force of gravity the distance needed to reach opening 106 are minimized or removed entirely. Thus, when in use, water from splashing, swells, waves or rain are prevented from entering opening 106 of the breathing tube 102.

With respect to the orientation of the slot 112, the slot 112 resides in a plane generally parallel to a surface of the water when the housing 110 is upright. Thus, when submerging, the slot 112 will go from open to the air to being sealed by water all at once. This provides a few advantages. First, when hitting the surface of the water, the slot 112 will cause an audible and recognizable sound, such as a pop, indicating that the slot is now submerged in the water. This audible and recognizable sound may be used by the swimmer as an indication that the slot 112 is submerged and that breathing through breathing tube 102 should stop.

Additionally, by providing the slot 112 in a plane parallel to the water, the slot will seal (hit the water) cleanly all at once, at which point, breathing through the snorkel stops. In conventional designs where a breathing hole may be horizontally oriented (perpendicular to the surface of the water), the hole seals slowly as the hole submerges beneath the surface of the water. In such conventional designs, as the portion of the hole above the water gets smaller, breathing is still allowed, but given the smaller open area of the hole, air is pulled in at a greater velocity to maintain the required flow of air for breathing. A problem with pulling an air at a greater velocity near the water surface is that the greater velocity may also pull water, mist and/or water droplets into the conventional hole as well. Providing the slot 112 parallel to the service of the water which seals all at once alleviates this problem found in conventional snorkel slot designs.

With respect to the orientation and shape of the slot 112, conventional holes which are horizontal and forward facing can easily get covered with debris as a swimmer moves through the water. If debris gets into the hole, gravity will pull it down into the breathing tube. By providing a slot oriented downward toward the water, this minimizes the chance that debris will get stuck in the slot 112. In the event the slot 112 does encounter debris, gravity will tend to force the debris out of the slot 112 rather than into the slot and up into the breathing tube.

It is a further advantage of the orientation and shape of the slot 112 that it allows water to quickly escape from within the housing 110 when the housing 110 is elevated above the water surface. This allows air to immediately enter the housing 110 and the breathing tube 102 thereby allowing the individual to freely breathe quickly upon surfacing, without having to exhale to clear water for the breathing tube 102.

Figure 9:
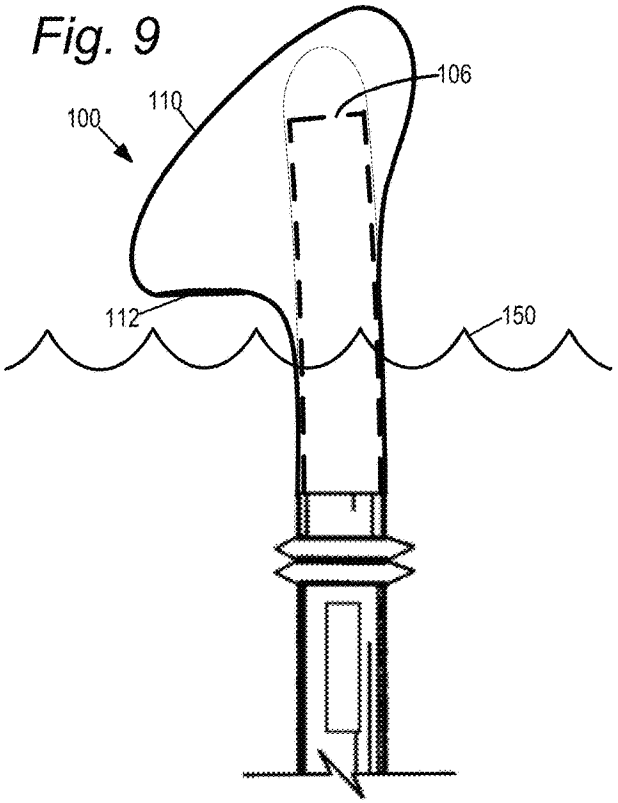
FIG. 9 shows a front view of a portion of a snorkel according to embodiments of the present technology with a housing above a surface of the water.

When in use at a surface of the water, the user may breathe freely while their head is submerged and with the housing 110 above the surface of water 150 as shown in FIG. 9. When in use at the surface of the water, the housing 110 and slot 112 cooperate to prevent water from entering the upper opening 106 of the breathing tube 102 as noted above.

Figure 10:
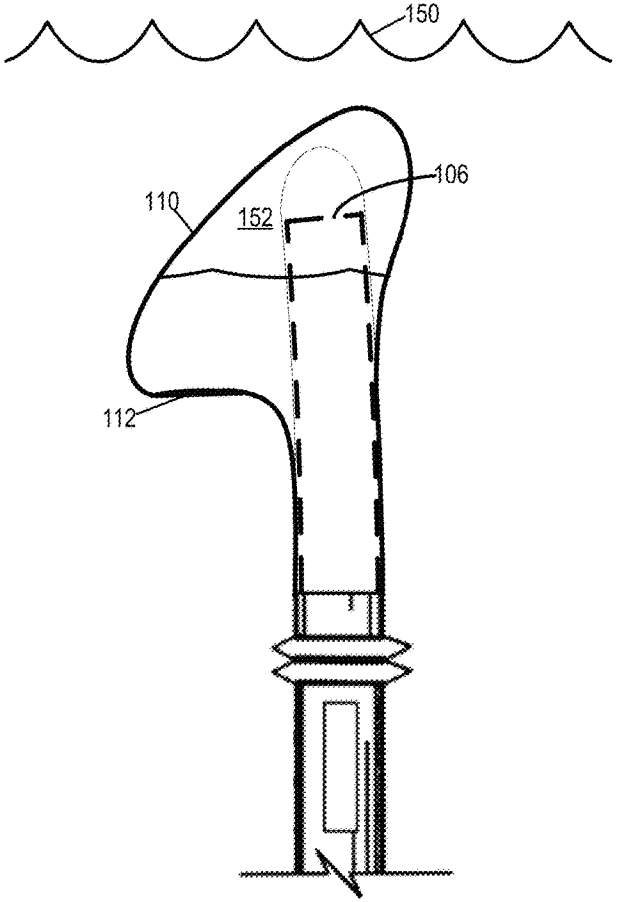
FIG. 10 shows a front view of a portion of a snorkel according to embodiments of the present technology with a housing submerged beneath a surface of the water.

Additionally, when a swimmer submerses the snorkel 100 completely beneath a surface of water 150, as shown in FIG. 10, the housing 110 and slot 112 cooperate to prevent water from entering the upper opening 106 of the breathing tube 102. In particular, when the snorkel goes beneath the surface of water 150, water will enter slot 112. As the housing is enclosed other than slot 112, the entering water will create an air pocket 152. The water level within the interior of the housing 110 rises until the air pressure of air pocket 152 within the cavity of the housing 110 equals the water pressure of the surrounding water based upon the depth of the dive.

The volume of air pocket 152 will vary, depending on the depth of the snorkel and the pressure of the surrounding water. However, the volume of air trapped in the housing 110, and the distance between the slot 112 and upper opening 106 (along the axis of upper portion 108), are selected so that the volume of the air pocket 152 will not compress to the point where water rises above the height of the upper opening 106 for any reasonable maximum diving depth.

In examples, the volume of the housing 110 may be 8 cubic inches. With this volume and the distance between the slot 112 and opening 106 discussed above, the volume of the air pocket 152 will not compress to the point where water rises above the height of the upper opening 106 for any reasonable maximum diving depth.

However, it is understood that the above-mentioned volumes and distance between the slot 112 and upper opening 106 may be larger or smaller than the above values in further embodiments. In some embodiments, snorkels 100 may be customized for use at different depths, and for different skill levels of divers. For example, snorkels 100 for use by novice divers who will not be diving to deep may have a relatively small volume within housing 110 and/or a relatively small distance between slot 112 and upper opening 106. Conversely, snorkels 100 for use by experienced divers who may be diving to greater depths may have a larger volume within housing 110 and/or a larger distance between the slot 112 and upper opening 106.

Figure 11:
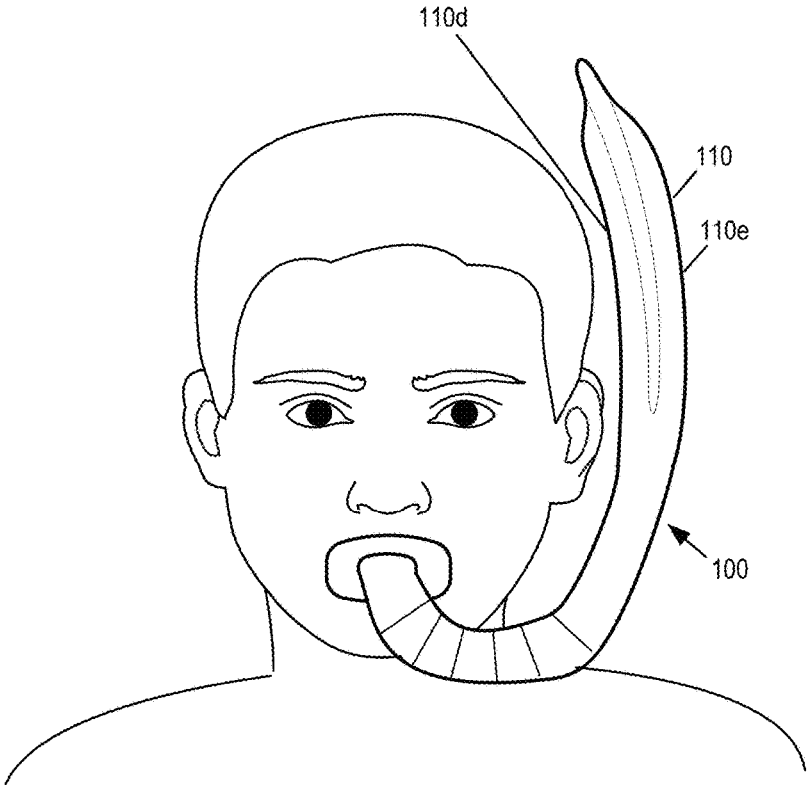
FIG. 11 shows a view of a snorkel according to embodiments of the present technology as worn by a user while snorkeling.

In accordance with a further aspect of the present technology, the housing 110 is provided with a shape that generally conforms to the shape of a user's head. For example, as shown in FIG. 11, a front surface 110*d* of the housing 110 may have a generally concave shape, and a back surface 110*e* of the housing 110 may have a generally convex shape. This allows the housing 110 to generally conform to the shape of a user's head, and rest next to a user's head when the snorkel 100 is used. This provides a hydrodynamic profile to the housing 110, and minimizes drag as a user is swimming with snorkel or diving beneath a surface of the water with snorkel 100. It is conceivable that the front portion 110*d* be concave, and conform to the head of a user, while the back portion 110*e* is flat.

In summary, an example of the present technology relates to a snorkel comprising: a breathing tube comprising a first end configured to be received in a mouth of a user and an upper opening in a second end opposite the first end; a housing around the upper opening; and a slot in the housing, the slot configured to reside in a horizontal plane with respect to gravity when the snorkel is in use in water, the housing and slot together configured to trap an air pocket within the housing when the housing is submerged underwater, with the upper opening of the breathing tube positioned in the air pocket.

In another example, the present technology relates to a snorkel comprising: a breathing tube comprising a first end configured to be received in a mouth of a user and an upper opening in a second end opposite the first end; a housing around the upper opening, the housing comprising a first surface having a concave contour and a second surface, opposite the first surface, having a convex contour; and a slot in the housing, the housing and slot together configured to trap an air pocket within the housing when the housing is submerged underwater, with the upper opening of the breathing tube positioned in the air pocket to prevent water from entering the upper opening.

In a further example, the present technology relates to a snorkel comprising: a breathing tube comprising a first end configured to be received in a mouth of a user and an upper opening in a second end opposite the first end; a housing around the upper opening, the housing comprising a first surface having a concave contour and a second surface, opposite the first surface, having a convex contour, the first and second surfaces having the shape of a dorsal fin; a slot in a bottom portion of the dorsal fin-shaped first and second surfaces, the slot positioned vertically below the upper opening when the housing is vertically oriented, the housing and slot together configured to trap an air pocket within the housing when the housing is submerged underwater and vertically oriented, with the upper opening of the breathing tube positioned in the air pocket to prevent water from entering the upper opening.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A snorkel comprising:

a breathing tube comprising a first end configured to be received in a mouth of a user and an upper opening in a second end opposite the first end;

a housing around the upper opening; and a slot in a surface of the housing, the surface and slot configured to be horizontally oriented with respect to gravity when the snorkel is in use in water, the housing and slot together configured to trap an air pocket within the housing when the housing is submerged underwater, with the upper opening of the breathing tube positioned in the air pocket, wherein the housing comprises a top portion having first and second surfaces, the first and second surfaces coming together with each other at edges, the edges comprising an angled edge and a flat horizontal edge when the second end of the breathing tube is vertically oriented, and wherein the slot is provided in the flat horizontal edge.

2. The snorkel of claim 1, wherein the slot is spaced from the upper opening by three inches along an axis of the breathing tube.

3. The snorkel of claim 1, wherein the pocket of air compresses to a smaller volume when the housing submerges to deeper depths within the water.

4. The snorkel of claim 3, wherein a volume of the housing is provided to trap an air pocket that is large enough to prevent water from entering the upper opening up to a predefined depth within the water.

5. The snorkel of claim 3, wherein a distance between the slot and the upper opening, along the breathing tube, is provided to prevent water from entering the upper opening up to a predefined depth within the water.

6. The snorkel of claim 1, wherein the slot is provided in the first surface of the housing.

7. The snorkel of claim 1, wherein slot is provided in the second surface of the housing.

8. A snorkel for use in a body of water, the snorkel comprising:

a breathing tube comprising a first end configured to be received in a mouth of a user and an upper opening in a second end opposite the first end;

a housing around the upper opening, the housing comprising a first surface having a concave contour and a second surface, opposite the first surface, having a convex contour; and a slot in a surface of the housing, the surface and slot configured to be parallel to a surface of the body of water upon submersion of the housing into the body of water, the housing and slot together configured to trap an air pocket within the housing when the housing is submerged within the body of water, with the upper opening of the breathing tube positioned in the air pocket to prevent water from entering the upper opening, wherein the housing comprises a top portion having first and second surfaces, the first and second surfaces coming together with each other at edges, the edges comprising an angled edge and a flat horizontal edge, wherein the slot is provided in the flat horizontal edge when the second end of the breathing tube is vertically oriented.

9. The snorkel of claim 8, wherein the concave and convex contours of the first and second surfaces of the housing are configured to conform to a shape of a human head.

10. The snorkel of claim 8, wherein the slot is spaced from the upper opening by three inches along an axis of the breathing tube.

11. The snorkel of claim 8, wherein the pocket of air compresses to a smaller volume when the housing submerges to deeper depths within the water.

12. The snorkel of claim 11, wherein a volume of the housing is provided to trap an air pocket that is large enough to prevent water from entering the upper opening up to a predefined depth within the water.

13. The snorkel of claim 11, wherein a distance between the slot and the upper opening, along the breathing tube, is provided to prevent water from entering the upper opening up to a predefined depth within the water.

14. A snorkel comprising:

a breathing tube comprising a first end configured to be received in a mouth of a user and an upper opening in a second end opposite the first end;

a housing around the upper opening, the housing comprising a first surface having a concave contour and a second surface, opposite the first surface, having a convex contour, the first and second surfaces coming together with each other at edges, the edges comprising an angled edge and a flat horizontal edge when the second end of the breathing tube is vertically oriented;

a slot in the flat horizontal edge, the slot positioned vertically below the upper opening when the housing is vertically oriented, the housing and slot together configured to trap an air pocket within the housing when the housing is submerged underwater and vertically oriented, with the upper opening of the breathing tube positioned in the air pocket to prevent water from entering the upper opening.

15. The snorkel of claim 14, wherein the concave contour of the first surface is configured to conform to a convex shape of a human head.

* * * * *